United States Patent [19]

Kakizoe et al.

[11] Patent Number: 4,616,203

[45] Date of Patent: Oct. 7, 1986

[54] ELECTROMAGNETIC CONTACTOR

[75] Inventors: Masahiro Kakizoe; Shizutaka Nishizako; Shigeru Masuda, all of Aichi; Yuichi Wada; Teijiro Mori, both of Hyogo, all of Japan

[73] Assignee: Mitsubishi Denki Kabushiki Kaisha, Japan

[21] Appl. No.: 677,406

[22] Filed: Dec. 3, 1984

[30] Foreign Application Priority Data

Dec. 1, 1983 [JP] Japan ..... 58-184549[U]

[51] Int. Cl.[4] ..... H01H 9/30

[52] U.S. Cl. ..... 335/201; 200/144 R; 335/131

[58] Field of Search ..... 335/201, 131; 200/144 R

[56] References Cited

U.S. PATENT DOCUMENTS

| | | | |
|---|---|---|---|
| 3,005,892 | 10/1961 | Yarrick | 200/144 R |
| 4,019,005 | 4/1977 | Michetti | 200/144 R |
| 4,393,287 | 7/1983 | Nakano | 200/144 R |

FOREIGN PATENT DOCUMENTS

| | | |
|---|---|---|
| 1121160 | 1/1962 | Fed. Rep. of Germany . |
| 1194956 | 6/1965 | Fed. Rep. of Germany . |
| 1640265 | 8/1970 | Fed. Rep. of Germany . |
| 1926693 | 11/1970 | Fed. Rep. of Germany . |
| 1413915 | 7/1972 | Fed. Rep. of Germany . |
| 2949012 | 6/1981 | Fed. Rep. of Germany . |

*Primary Examiner*—Harold Broome

*Attorney, Agent, or Firm*—Sughrue, Mion, Zinn, Macpeak, and Seas

[57] ABSTRACT

An electromagnetic contactor in which at least one pair of contacts which disengage from each other to interrupt a current are provided in an arc-extinguishing chamber defined by a partition wall of electrically insulating material. An absorbing member of porous metal is provided on the inner surface of the partition wall to absorb molten metal particles which are formed by arcing at the time of disengagement of the contacts. A shield plate of electrically insulating material is provided on the inner surface of the absorbing member, and through-holes are formed in the partition wall of the arc-extinguishing chamber and the shield plates in such a manner that the through-holes of the partition wall are non coincident in position with those of the shield plate so that the absorbing member is protected from damage.

6 Claims, 5 Drawing Figures

ELECTROMAGNETIC CONTACTOR

BACKGROUND OF THE INVENTION

The present invention relates to an electromagnetic contactor in which the high temperature gas or molten metal formed upon interruption of a current is cooled with a porous metal.

A conventional electromagnetic contactor in which a high temperature gas or molten metal is cooled with porous metal is constructed, for instance, as shown in FIG. 1. In the contactor of FIG. 1, the right and left halves are symmetrical with respect to each other, and hence only the right half is shown in detail.

As shown in FIG. 1, a stationary iron core 12 is fixedly mounted on a mounting stand 10 substantially at the center of the contactor. The mounting stand 10 is made of an insulating material, and the iron core 12 is formed by laminating silicon steel plates. A movable iron core 14 formed by laminating silicon steel plates is provided above the stationary iron core 12. The movable iron core 14 has an associated tripping spring (not shown). An operating coil 16 is wound on the stationary iron core 12. When current is applied to the operating coil 16, the movable iron core 14 is attracted by the stationary iron core 12 against the elastic force of the spring by the action of the electromagnet.

The movable iron core 14 is vertically movably supported on a cross bar 18 made of an insulating material and which has formed therein a square window 18*a*. A movable contact piece 20 is inserted into the square window 18*a* of the cross bar 18. A movable contact 22 is formed on one end of the contact piece 20. A spring 24 is elastically inserted between the part of the movable contact piece 20 which is inserted into the square window 18*a* and the cross bar 18.

A stationary contact 26 is arranged in such a manner as to confront the movable contact 22. More specifically, the stationary contact 26 is fixedly mounted on the substantially U-shaped end portion of a stationary contact piece 28. As the movable iron core 14 is moved vertically, the movable contact 22 is also moved vertically into or out of engagement with the stationary contact. The stationary contact piece 28 extends over a base 30 in the rightward direction in FIG. 1. The exposed part of the stationary contact piece 28 is a terminal section which has a terminal screw 34 through which the contactor is connected to an external circuit.

The movable contact piece 20 and a part of the stationary contact piece 28 are provided in an arc-extinguishing chamber 40 with partition walls 36 and 38 made of an insulating material. The partition wall 36 has a plurality of through-holes 42 through which high temperature gas or molten metal particles produced at the interruption of current are discharged to the outside. An absorbing member 44 made of porous metal is laid on the inner surface of the partition wall 36.

A commutation electrode 46 is provided near the movable contact 22 and an arc runner 48 is arranged near the stationary contact 26. A plurality of magnetic metal arc-extinguishing plates 50 for pulling and extinguishing an arc $A_1$ are provided extending parallel to the surfaces of the stationary contact piece 28 and the stationary contact 26. That is, the plates 50 are arranged in a direction perpendicular to the direction in which the movable contact piece 20 is moved away from the stationary contact piece 28. Accordingly, the arc $A_1$ produced upon between the movable contact 22 and the stationary contact 26 is extinguished while moving through states indicated by $A_2$, $A_3$ and $A_4$ in FIG. 1.

The operation of the electromagnetic contactor thus constructed will now be described.

Under the condition that the movable contact 22 is in contact with the stationary contact 26, current is applied to the coil 16 and the movable iron core 14 is attracted by the stationary iron core 12. When, under this condition, application of the current to the coil 16 is suspended, the movable iron core 14 is moved away from the stationary iron core 12 by the action of the tripping spring (not shown), and accordingly the movable contact 22 is disengaged from the stationary contact 26. As a result, an arc $A_1$ is produced between the contacts. The arc $A_1$ thus produced is shifted into the space between a commutation electrode 46 and the arc runner by the attracting magnetic action of the metal arc-extinguishing plates 50 and the magnetic force of the currents flowing in the movable contact piece 20 and the stationary contact piece 28; that is, the arc $A_1$ becomes an arc $A_2$ in this space. The arc $A_2$ is moved to the right in FIG. 1, becoming an arc $A_3$ and then an arc $A_4$. Thus, the arc, being cut and cooled by the metal arc-extinguishing plates 50, is extinguished.

During the period of time between the production and extinction of the arc, the ambient air is ionized, producing a high temperature gas, while the surrounding metal parts are made molten and are evaporated. The high temperature gas and the molten metal are discharged to the outside through the through-holes 42 in the partition wall 36 as the pressure in the arc-extinguishing chamber 40 increases. In this operation, the high temperature gas is reduced as the gas passes through the absorbing member 44, and the molten metal particles stick to the absorbing member 44.

The existence of the high temperature gas or the molten metal particles reduces the insulating effect in the arc-extinguishing chamber 40. However, as the high temperature gas is cooled by the absorbing member 44 and discharged and the molten metal particles are absorbed by the absorbing member 44, the insulating effect in the arc-extinguishing chamber 40 is recovered, and therefore the interruption performance is improved. Furthermore, external short-circuiting and damage to external parts due to the high temperature gas and molten metal particles are prevented.

However, the conventional electromagnetic contactor is disadvantageous in the following points: When a large current is interrupted repeatedly with the contactor, a part of the absorbing member 44 may be made molten by the molten metal particles, thus forming a through-hole 52 in the absorbing member 44. If a throughhole 52 is formed in the absorbing member 44, then the latter cannot sufficiently cool the high temperature gas or the molten metal particles and cannot satisfactorily prevent the entrance of dust into the arc-extinguishing chamber 40.

SUMMARY OF THE INVENTION

In view of the foregoing, an object of the invention is to provide an electromagnetic contactor in which the absorbing member is protected from damage and the effects of cooling the high temperature gas, absorbing the molten metal particles and dustproofing are maintained, even when the interruption of current is repeatedly carried out.

The foregoing object and other objects of the invention have been achieved by the provision of an electromagnetic contactor in which a shield plate having a plurality of through-holes is placed on the absorbing member in such a manner that the absorbing member is held between the shield plate and the partition wall with the positions of the through-holes of the shield plate being not coincident with those of the through-holes of the partition wall.

The nature, principle and utility of the invention will become more apparent from the following detailed description when read in conjunction with the accompanying drawings.

DESCRIPTION OF THE PREFERRED EMBODIMENTS

The invention will be described in detail with reference to preferred embodiments shown in the accompanying drawings.

Figure 2:
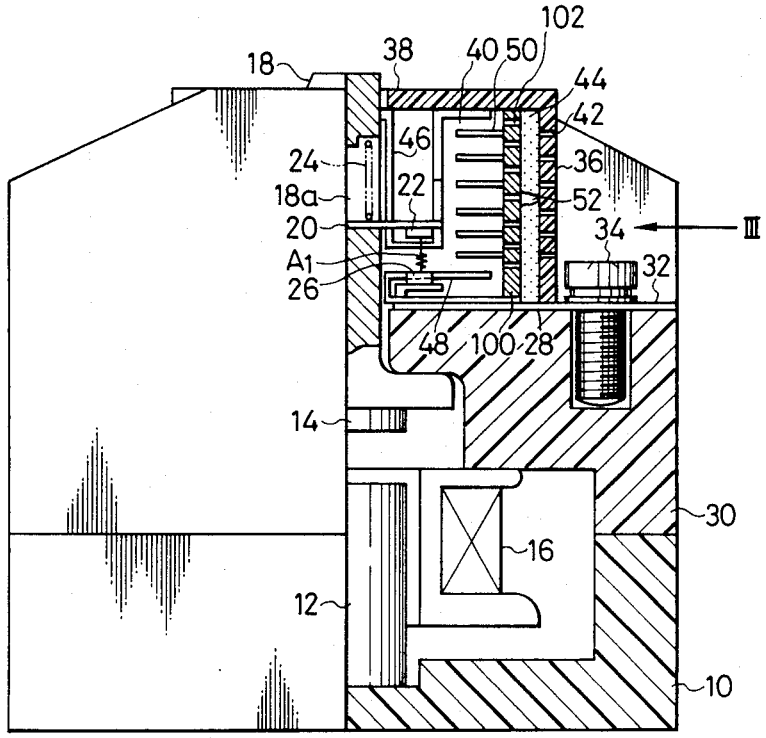
FIG. 2 is a front view, half being in cross section, showing a first example of an electromagnetic contactor according to the invention.
Figure 3:
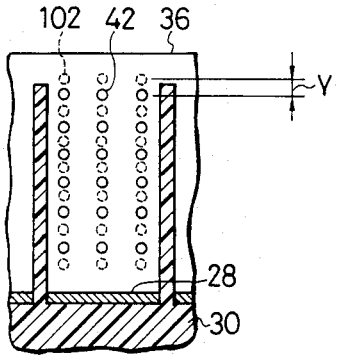
FIG. 3 is a side view of essential components of the contactor of FIG. 2 as viewed in the direction of an arrow III in FIG. 2.

FIG. 2 shows a first example of an electromagnetic contactor constructed according to the invention, and FIG. 3 is a sectional diagram of essential parts of this contactor as viewed in the direction of an arrow III in FIG. 2.

As shown in FIGS. 2 and 3, a stationary iron core 12 is fixedly mounted on a mounting stand 10 substantially at the center thereof. The mounting stand 10 is made of an insulating material, and the iron core 12 is formed by laminating silicon steel plates. A movable iron core 14 also formed by laminating silicon steel plates is provided above the stationary iron core 12. A tripping spring (not shown) is connected to the movable iron core 14. An operating coil 16 is wound on the stationary iron core 12. When current is applied to the operating coil 16, the movable iron core 14 is attracted by the stationary iron core 12 against the elastic force of the spring by the action of the electromagnet. The movable iron core 12 is vertically movably supported on a cross bar 18 which is made of insulating material and which a square window 18*a*.

A movable contact piece 20 extends through the square window 18*a* of the cross bar 18. A movable contact 22 is formed on one end of the contact piece 20. A spring 24 is elastically inserted between the part of the movable contact piece 20 accommodating the square window 18*a* and the cross bar 18.

Figure 1:
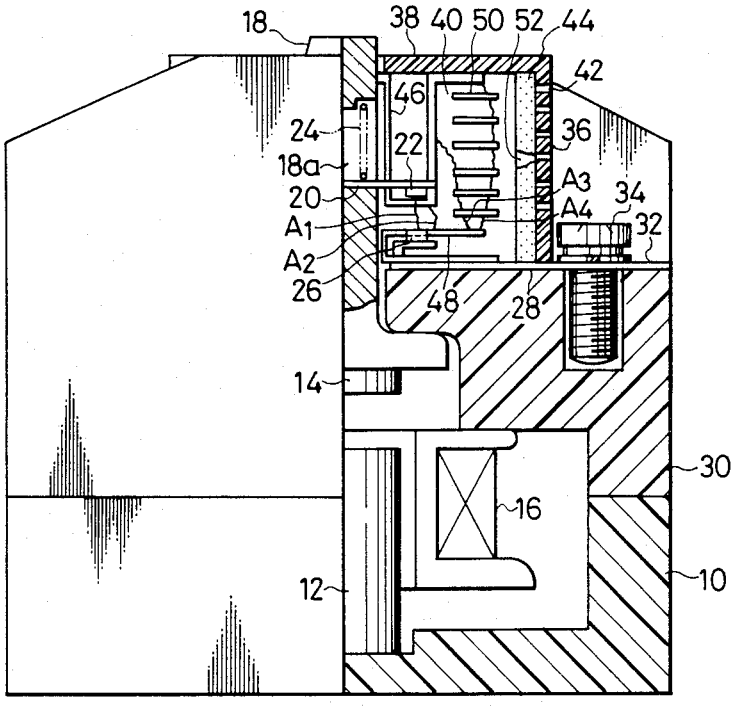
FIG. 1 PRIOR ART
FIG. 1 is a front view, half being in cross section, showing an example of an electromagnetic contactor to which the technical concept of the invention is applied.

A stationary contact 26 is arranged in such a manner as to confront the movable contact 22. More specifically, the stationary contact 26 is fixedly mounted on the substantially U-shaped end portion of a stationary contact piece 28. As the movable iron core 14 is moved vertically, the movable contact 22 is also moved vertically into or out of engagement with the stationary contact 26. The stationary contact piece 28 extends over a base 30, to the right as viewed in FIG. 1. The exposed part of the stationary contact piece 28 is a terminal section which has a terminal screw 34 through which the contactor is connected to an external circuit.

The movable contact piece 20 and a part of the stationary contact piece 28 are provided in an arc-extinguishing chamber 40 with partition walls 36 and 38 made of an insulating material. The partition wall 36 has a plurality of through-holes 42 through which high temperature gas or molten metal particles produced at the interruption of current are discharged to the outside. An absorbing member 44 of porous metal is laid on the inner surface of the partition wall 36.

In addition, a shield plate 100 of electrically insulating material is placed on the inner surface of the absorbing member 44. That is, the absorbing member 44 is set between the partition wall 36 and the shield plate 100. The shield plate 100 has a plurality of through-holes 102 which, when the shield plate is set in place, are shifted vertically from the through-holes 42 of the partition wall 36 by the distance Y indicated in FIG. 3 so that the former do not overlap the latter.

A commutation electrode 46 is provided near the movable contact 22, and an arc runner 48 is arranged near the stationary contact. A plurality of magnetic metal arc-extinguishing plates 50 for pulling and extinguishing an arc $A_1$ are provided, extending parallel to the surfaces of the stationary contact piece 28 and the stationary contact 26.

The operation of the electromagnetic contactor thus constructed will now be described.

When the movable contact 22 is moved away from the stationary contact 26, an arc $A_1$ is produced therebetween. When the arc $A_1$ thus produced is extinguished, high temperature gas and molten metal particles are formed. The high temperature gas is caused to flow through the through-holes 102 of the shield plate 100 into the pores of the absorbing member 44 where it is cooled. The gas thus cooled is discharged through the through-holes 42 of the partition wall 36.

The molten metal particles pass into the pores of the absorbing member 44 through the through-holes 102 of the shield plate 100. Most of the molten metal particles adhere to the absorbing member 44. Molten metal particles which do not adhere to the absorbing member 44 strike the partition wall 36. Since the through-holes 102 of the shield plate 100 are shifted from the through-holes 42 of the partition wall 36 as described before, molten metal particles passing through the absorbing member 44 strike the partition wall 36 without passing through the through-holes 42 thereof. The molten metal particles are large in mass. Therefore, the molten metal particles, unlike the high temperature gas, will not be discharged through the through-holes 42 of the partition wall 36.

When a large current is interrupted repeatedly, a hole 52 may be formed in the absorbing member 44. Even in this case, the hole 52 does not communicate with any of the through-holes 42 of the partition wall 36. Therefore, the arc-extinguishing chamber 40 is protected from the entrance of dust. On the other hand, the high temperature gas can pass through the pores in the part of the absorbing member 44 which has not been rendered molten. Therefore, the gas is cooled and discharged through the through-holes 42 of the partition wall 36. Accordingly, the cooling effect is not be reduced even if a hole is formed in the absorbing member by repetitive interruption of a large current.

Figure 5:
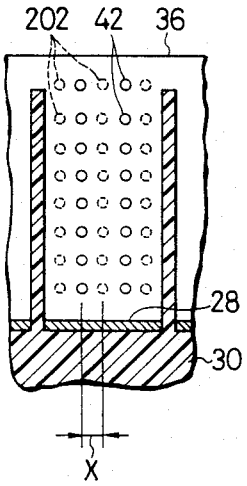
FIG. 5 is a side view of essential components of the contactor of FIG. 4 as viewed in the direction of an arrow V in FIG. 4.
Figure 4:
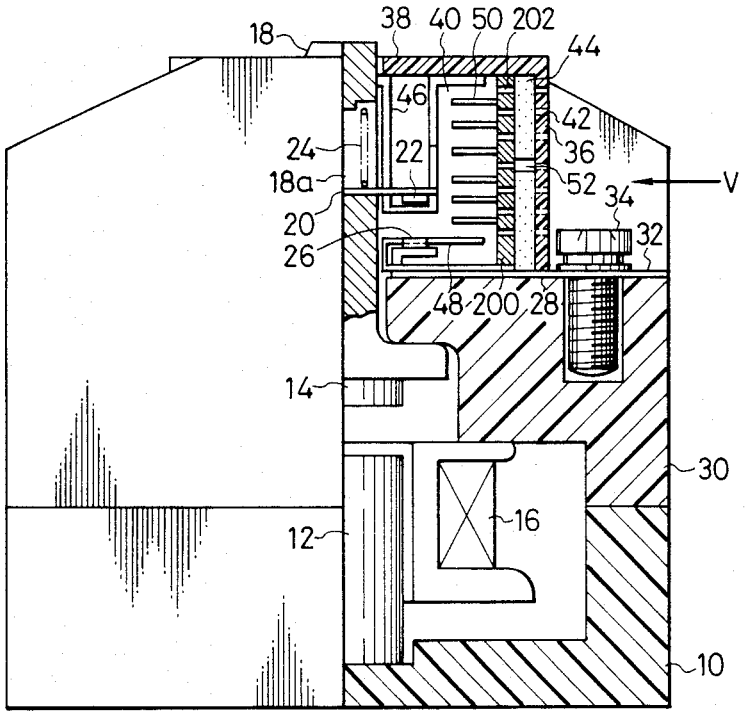
FIG. 4 is a front view, half being in cross section, showing a second example of an electromagnetic contactor according to the invention.

A second example of an electromagnetic contactor constructed according to the invention will be described with reference to FIGS. 4 and 5. In these figures, those components which have been previously described with reference to FIGS. 2 and 3 are designated by the same reference numerals or characters. FIG. 5 shows essential components of the contactor as viewed in the direction of an arrow V in FIG. 4.

In this embodiment, the through-holes 202 of the shield plate 200 are shifted from the through-holes 42 of the partition by a distance of X in a horizontal direction as indicated in FIG. 5. That is, the second example of the electromagnetic contactor differs from the first example in the direction of shifting of the through-holes of the shield plate from the through-holes of the partition wall. However, the second example is similar to the first example in that the positions of the throughholes of the shield plate are not coincident with those of the through-holes of the partition wall. Accordingly, the effects of the second example are similar to those of the first example.

The partition wall 36, the absorbing member 44 and the shield plate 100 or 200 may be formed as an integral unit. Furthermore, the partition wall 36 may be replaced by a shield plate such as the shield plate 100 or 200.

As is apparent from the above description, in the electromagnetic contactor according to the invention, the absorbing member of porous metal adapted to cool and absorb the high temperature gas and molten metal particles which are produced during current interruption is arranged between the insulating members having through-holes in such a manner that the through-holes of one of the insulating members are shifted from those of the other. Therefore, the amount of damage to the absorbing member is decreased, and dust-proofing is maintained. Accordingly, even when a large current is interrupted repeatedly, cooling of the high temperature gas and trapping of the molten metal particles by the absorbing member are carried out effectively and continuously.

We claim:

1. An electromagnetic contactor comprising:

an arc-extinguishing chamber defined by a partition wall of electrically insulating material, said partition wall having a plurality of through-holes therein;

at least one pair of contacts which are provided in said arc-extinguishing chamber and which produces arcs at the interruption of an electric current flowing therethrough;

an absorbing member of porous metal arranged on an inner surface of said partition wall in such a manner as to cover said through-holes of said partition wall; and a shield plate of electrically insulating material which has a plurality of through-holes and which is arranged on an inner surface of said absorbing member in such a manner that said through-holes of said shield plate are shifted from the through-holes of said partition wall.

2. The electromagnetic contactor as claimed in claim 1, wherein said through-holes of said partition wall and said through-holes of said shield plate are arranged at like intervals.

3. The electromagnetic contactor as claimed in claim 1, wherein said pair of contacts disengage by moving in a predetermined direction, and said through-holes of said partition wall extend in a direction perpendicular to said predetermined direction.

4. The electromagnetic contactor as claimed in claim 1, wherein said pair of contacts disengage by moving in a predetermined direction, and said through-holes of said shield plate extend in a direction perpendicular to said predetermined direction.

5. The electromagnetic contactor as claimed in claim 1, further comprising a plurality of metal arc-extinguishing plates made of magnetic material provided in said arc-extinguishing chamber, located inwardly of said shield plate and extending in a direction perpendicular to a direction in which said contacts move to disengage.

6. The electromagnetic contactor as claimed in claim 5, wherein said plurality of metal arc-extinguishing plates arranged in said arc-extinguishing chamber are shifted from said through-holes of said shield plate.

* * * * *